United States Patent [19]

Muller et al.

[11] 4,268,961

[45] May 26, 1981

[54] CUTTING DEVICE IN PARTICULAR PIN CUTTING

[75] Inventors: Alfred Muller, Ottrott; Jean-Paul Muller, Molsheim, both of France

[73] Assignee: J. Muller S.A., France

[21] Appl. No.: 39,281

[22] Filed: May 15, 1979

[30] Foreign Application Priority Data

May 17, 1978 [FR] France ..... 78 15170

[51] Int. Cl.[3] ..... B26B 17/00

[52] U.S. Cl. ..... 30/191

[58] Field of Search ..... 30/192, 191, 251, 190

[56] References Cited

U.S. PATENT DOCUMENTS

| | | | |
|---|---|---|---|
| 102,006 | 4/1870 | Howard | 30/191 |
| 188,133 | 3/1877 | Hellwig | 30/191 |
| 374,480 | 12/1887 | Klein | 30/191 X |
| 1,455,297 | 5/1923 | Lyons | 30/192 |
| 3,949,473 | 4/1976 | Blanc | 30/191 |

*Primary Examiner*—Jimmy C. Peters

*Attorney, Agent, or Firm*—Robert E. Burns; Emmanuel J. Lobato; Bruce L. Adams

[57] ABSTRACT

A cutting device, particularly a bolt cutting device, is formed of two cutting blades pivoted around two fixed pins held by two side plates and actuated by two lever arms respectively pivoting around two other fixed pins on the same side plates. Pivot elements connect front ends of said lever arms with rear ends of said cutting blades. In one embodiment there are four pivot elements, two connecting each blade with the respective lever arm. Cross members of the same thickness as the pivot elements connect the two pivot pins on which the cutting blades are pivoted thereby permitting the use of thinner side walls. In another embodiment the rear end of each cutting blade and the front end of each lever arm is slotted to receive the respective pivot element, connection being made by pivot pins through aligned holes in the pivot elements and slotted ends of the cutting blades and lever arms.

6 Claims, 5 Drawing Figures

CUTTING DEVICE IN PARTICULAR PIN CUTTING

FIELD OF INVENTION

This invention relates to a cutting and particularly a bolt-cutting device which is formed of two cutting blades pivoted around two fixed pins held by two side plates and actuated by lever arms pivoted respectively around two other pins held by the same side plates.

BACKGROUND OF THE INVENTION

Pincers for crimping sleeves on the ends of electric cables are already known from U.S. Pat. No. 2,992,576. These pincers comprise two jaws pivoted around a fixed pin and having elements adapted for said crimping at one of their ends. The other end of each jaw is connected by a pivot pin to one of the ends of a link. The two links, one for each jaw, are connected together by a pivot pin which passes through their other end and is located on the median axis of the pincers. This last-mentioned pivot pin also serves as connecting element between these two links and the upper end of a single central push member whose longitudinal axis is identical with the median axis of the pincers. The other end of said push member is connected via a pin which slides in grooves provided in the inner faces of the side plates to the center of rotation of two lever arms connected by pivot pins and via two connecting rods to the side plates of the pincers.

However, these pincers serve only for crimping a metal part and in general a part of sheet metal of slight thickness onto an electric cable and therefore the force which must be supplied is relatively slight while in order to cut a bolt and/or a round rod the force which must be supplied is very substantial. Thus in order to actuate the pincers of said U.S. patent, the free ends of the lever arms are brought together and a push is exerted on the central push member. Under the action of this central push member, the two links move out laterally which results in a lateral push being exerted on the ends of the jaws causing them to rotate and therefore to bring together the two elements contemplated for the crimping.

There are also known, from U.S. Pat. No. 2,229,263, pincers which serve in most cases either as flat-nosed pliers or as nippers. These pincers comprise two lever arms provided at their front end with two holes through which pivot pins are engaged. One of these pivot pins serves, on the one hand, as connecting element between the lever arm and one of the jaws and, on the other hand, as axis of rotation for said jaw while the other pivot pin serves as connecting element between said same lever arm and the other jaw. In this way, each jaw has two holes arranged on opposite sides of an opening.

However, there are concerned here simple pincers which, serving as nippers, permit the cutting only of metallic parts of small diameter since the unit is by no means designed to cut bolts or iron bars. Furthermore, the principle of these pincers is entirely different from a bolt cutter, such as forms the object of the present invention since during operation there is displacement in one direction of the connecting pins and displacement in the other direction of the rotation pins of the jaws.

Similarly from French Pat. No. 74.06037 there is known a bolt cutter which comprises two blades pivoted on a common support, two arms also pivoted on this same support, and means for transmitting forces and movements between the blades and the arms. The blades and the arms are pivoted on pins which are fixed in position in the common support which is formed by at least one cheek while the front ends of the arm are arranged between the rear ends of the blades and the means for transmitting the forces between each arm and blade are formed of a link whose ends are pivoted, one to the rear end of the blade and the other to the front end of the corresponding arm. Each link has at its two ends a cylindrical enlargement adapted to be fitted in a semi-cylindrical recess provided in the rear portion of each blade and in the front portion of each arm respectively. Each arm has at its front end opposite its homolog, on the one hand a stop face arranged behind its pivot pin on the cheeks and intended to cooperate with the corresponding face of the facing arm in order to limit the angle of closure of the two arms to a value which is compatible with human morphology and on the other hand a stop face arranged in front of the said pivot pin and intended to limit the maximum angle of opening so that the maximum value of the distance between two handles fastened to the rear ends of the arms is not greater than human possibilities.

In this cutting device, the force is a push force. When it is desired to move the two articulated blades apart, the semi-cylindrical recess of the front portion of each arm exerts a pull on the cylindrical enlargement of the link. The latter, by its second enlargement, exerts a pull on the semi-cylindrical recess of the rear portion of each blade. However, the forces exerted on the semi-cylindrical recesses of the arm and/or of the blade are concentrated on the portions of these recesses which are located beyond the diameter of the said recesses. Therefore, there is obtained premature wear or even a breaking of these parts, resulting in a disconnection between the links and the arms and/or articulated blades. Moreover, these recesses have an open region and therefore the risk of the penetration of foreign bodies.

SUMMARY OF THE INVENTION

The object of the present invention is to remedy this difficulty. The invention, as characterized in the claims, solves the problem which consists of creating a cutting device, in particular a bolt cutter, the force of which is a traction force exerted on the rear ends of the cutting blades via pivot elements which are connected, on the one hand, to the cutting blades and on the other hand to the lever arms by pivot pins which make it possible to obtain a high stepdown ratio. Therefore, with the same force one can cut bolts or round rods of a diameter greater than that of the bolts or round rods cut with the known devices.

The advantages obtained as a result of this invention, in addition to the one which has been cited above, also consist of the fact that the cutting device has connecting means which are located in a plane different from that of the arms and/or cutting blades, which makes it possible to obtain an empty space between, on the one hand, the arms and/or the cutting blades and, on the other hand, the two side plates. Therefore, all rubbing of the cutting blades on the inner faces of the side plates is eliminated. Furthermore, the robustness of the cutting tool is considerably increased since a cross member can be inserted between the cutting blades. and the side plates, which makes it possible to prevent, under the effect of pressure and/or traction exerted on the pivot pins of the cutting blades, an ovalizing of the holes provided on the one hand in the cutting blades and on the other hand in the two side plates.

BRIEF DESCRIPTION OF DRAWINGS

The invention will be explained in further detail below with reference to drawings which show merely a single embodiment.

DESCRIPTION OF PREFERRED EMBODIMENTS

Figure 1:
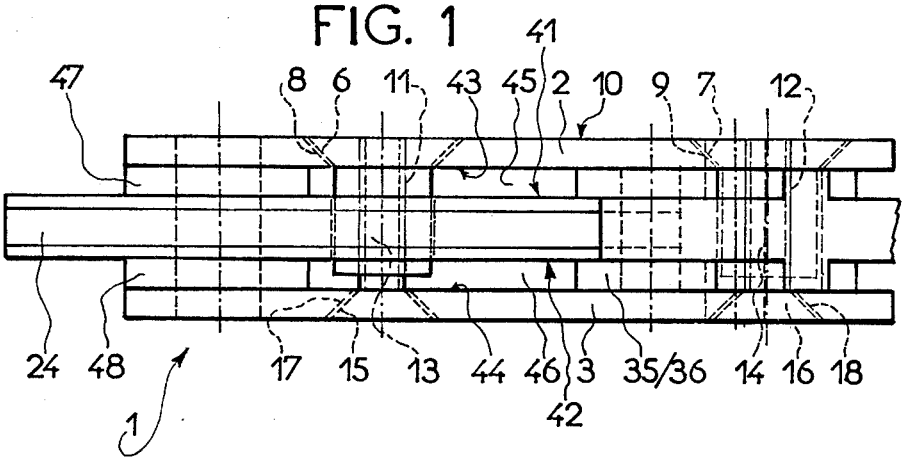
FIG. 1 is a view in elevation of the active mechanism of the bolt cutter in accordance with the invention.
Figure 2:
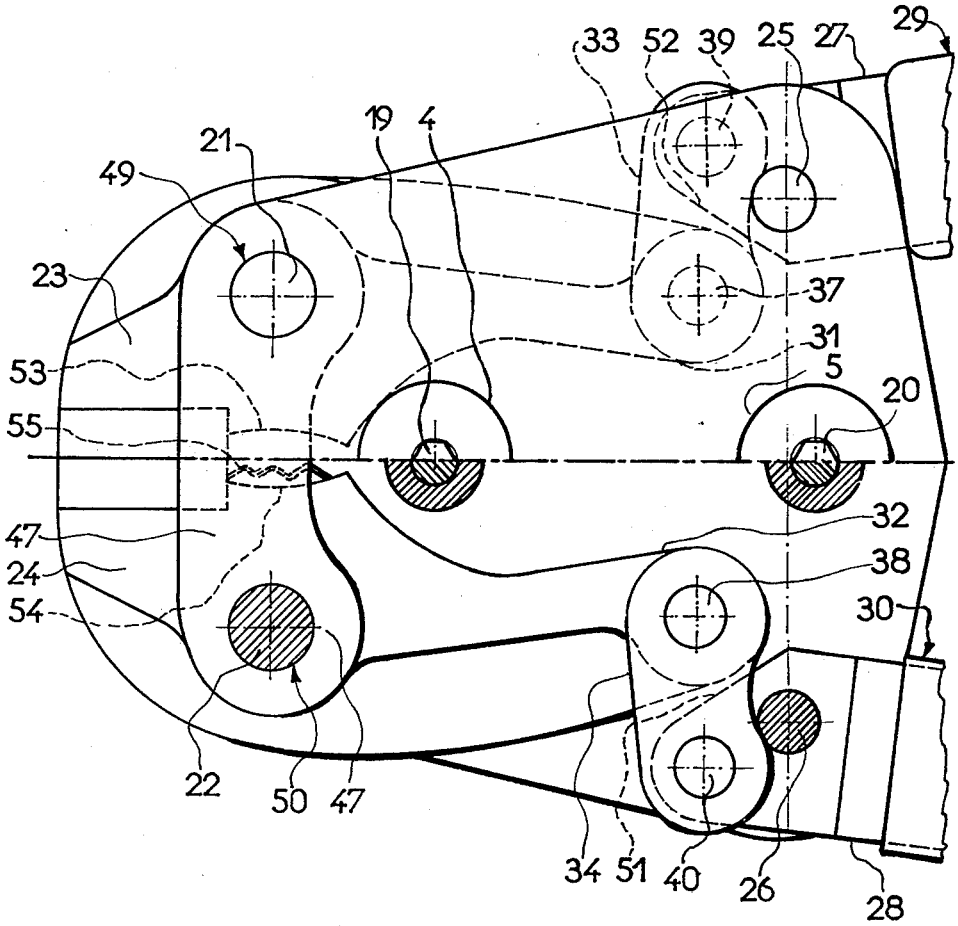
FIG. 2 is a plan view of the bolt cutter, the upper side plate being partially removed.

Let us refer to FIGS. 1 and 2.

The bolt cutter 1 has two parallel side plates 2, 3 connected together by cross members 4, 5 having a frustoconical head 6, 7 embedded in a frustoconical hole 8, 9 produced in the outer face 10 of the upper side plate 2 and a threaded bore 11, 12. Into this threaded bore 11, 12 there is screwed a screw 13, 14 whose frustoconical head 15, 16, embedded in a furstoconical hole 17, 18 made in the lower side plate 3, has a hollow hexagon 19, 20.

The parallel side plates 2, 3 are traversed by a first pair of fixed vertical pins 21, 22 serving as pivot pins for cutting blades 23, 24. Furthermore, the parallel side plates 2, 3 are traversed by a second pair of fixed vertical pins 25, 26 serving as pivot pins at the front ends 27, 28 of two lever arms 29, 30. The rear end 31, 32 of the cutting blades 23, 24 and the front end 27, 28 of the two lever arms 29, 30 are connected by pivot elements 33, 34 whose horizontal plane is different from the horizontal plane of the cutting blades 23, 24 and/or of the two lever arms 29, 30. These pivot elements 33, 34 permit a substantial stepdown of the forces.

In accordance with a first embodiment, upper pivot elements 33, 34 and lower pivot elements 35, 36 are provided. These pivot elements 33 to 36 are connected to the rear ends 31, 32 of the cutting blades 23, 24 by pivot pins 37, 38 and to the front ends 27, 28 of the two lever arms 29, 30 by pivot pins 39, 40. In this way a free space 45, 46 is obtained between the top 41 and the bottom 42 of the cutting blades 23, 24 and the inner faces 43, 44 of the side plates 2, 3, the height of said free space corresponding to the thickness of the pivot elements. Into this free space 45, 46 there are inserted two horizontal cross members 47, 48 which connect pivot pins 21, 22 to each other. The thickness of these cross members 47, 48 corresponds to the thickness of the pivot elements. Therefore the side plates 2, 3 simultaneously rest against the cross members and against the pivot elements and the surfaces of these side plates are parallel to each other. These cross members 47, 48 impart the unit a certain robustness and do away with any ovalization of the holes 49, 50 under the push and/or pull forces exerted on the pivot pins 21, 22. These cross members 47, 48 make it possible to reduce the thickness of the side plates 2, 3 while preserving for them a minimum strength of 20 kg/mm$^2$ both in compression and in tension. At the end of the stroke, the inner edges 51, 52 of the front ends 27, 28 of the two lever arms 29, 30 form a stop.

For synchronization of the transmission of the movement to the two cutting blades 23, 24 the inner edge 53, 54 of these cutting blades 23, 24 is provided with a toothing 55.

In order to cut the bolt or round rod, the two arms of the levers 29, 30 are brought together. These lever arms 29, 30 pivot around their fixed pins 25, 26. As a result, the pivot pins 39, 40 describe a circular arc around the center of the fixed pins 25, 26 the radius of which is the distance between the center of the fixed pins 25, 26 and the center of the pivot pins 39, 40. During this rotation, a pull is exerted on the pivot elements 33 to 36. The latter transmit this pull, via the pivot pins 37, 38, to the rear ends 31, 32 of the cutting blades 23, 24. As a result, the cutting blades 23, 24 pivot around fixed vertical pins 21, 22 and the cutting edges of these cutting blades 23, 24 move together until completely shearing the bolt or round iron.

Figure 3:
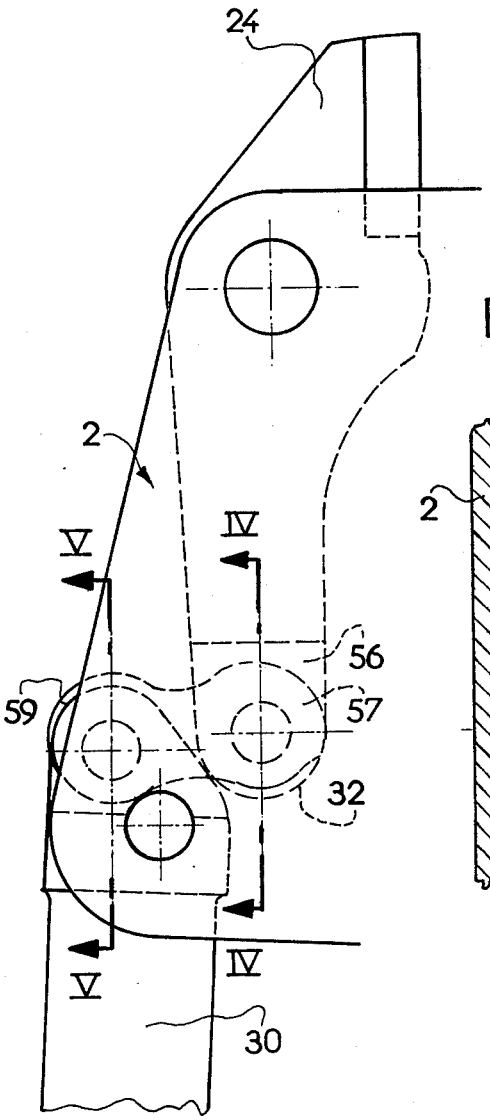
FIG. 3 is a partial plan view of the bolt cutter of the invention in accordance with another embodiment.
Figure 4:
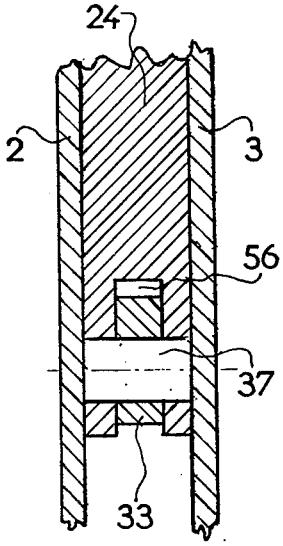
FIG. 4 is a partial view in cross section along the section line IV—IV of FIG. 3.
Figure 5:
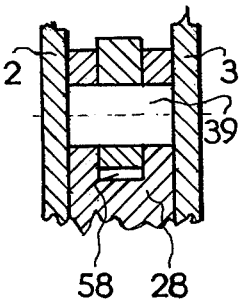
FIG. 5 is a partial cross sectional view along the section line V—V of FIG. 3.

Let us refer now to FIGS. 3, 4 and 5 which show another embodiment of the cutting tool. In accordance with this embodiment, in the rear end 31, 32 of the cutting blades 23, 24 there is provided a slot 56 into which there is inserted the end 57 of the pivot element 33, 34 connected to said rear end 31, 32 of the cutting blades 23, 24 by the pivot pin 37. Likewise in the front end 27, 28 of the two lever arms 29, 30 there is provided a slot 58 into which there is inserted the other end 59 of the pivot element 33, 34. The pivot pin 39 connects the pivot element 33, 34 to the front end 27, 28 of the two lever arms 29, 30.

We claim:

1. A cutting device, particularly a bolt cutting device comprising two parallel side plates spaced apart from one another, means rigidly connecting said side plates with one another, two cutting blades pivoted respectively around two fixed pins held by said side plates and having rear end portions extending rearwardly of said pivot pins, two lever arms pivoting respectively around two other fixed pins held by said side plates and having end portions extending forwardly of said latter pivot pins, pivot elements interposed between the rear ends of said cutting blades and the front ends of said lever arms respectively, said pivot elements being connected to the rear ends of said cutting blades and to the front ends of said lever arms by pivot pins having their longitudinal axes substantially perpendicular to the median axis of the cutting device, whereby a pull is exerted on each rear end of each cutting blade by said pivot elements upon movement of rear ends of said lever arms toward one another.

2. A device according to claim 1, in which said pivot elements comprise four pivot elements interposed between the inner faces of the side plates and the top and bottom respectively of the rear ends of the cutting blades and of the front ends of the lever arms, said four pivot elements being composed of two upper pivot elements connecting the top of each rear end of each cutting blade to the top of each front end of each lever arm and of two lower pivot elements connecting the bottom of each rear end of each cutting blade to the bottom of each lower end of each lever arm.

3. A device according to claim 2, in which said cutting blades are spaced from said side plates to provide open spaces between the top and the bottom of the cutting blades and the inner faces of the side plates, the height of these open spaces corresponding to the thickness of said pivot element.

4. A device according to claim 3, further comprising horizontal cross members inserted in said open spaces and connecting together the pivot pins around which the cutting blades pivot, the thickness of these cross members corresponding to the thickness of the pivot elements.

5. A device according to claim 1, in which the rear end of each of said cutting blades comprises a slot into which there is inserted one of the ends of the respective pivot element, the connection being effected by one of said pivot pins.

6. A device according to claim 5, characterized by the fact that the front end of each of said lever arms comprises a slot into which there is inserted the other end of the respective pivot element the connection being effected by one of said pivot pins.

* * * * *